US007362990B2

(12) United States Patent
Itagaki et al.

(10) Patent No.: US 7,362,990 B2
(45) Date of Patent: Apr. 22, 2008

(54) IMAGE FORMING APPARATUS

(75) Inventors: Seiko Itagaki, Hachioji (JP); Hiroshi Akita, Hino (JP); Isamu Miura, Ube (JP)

(73) Assignee: Konica Minolta Business Technologies, Inc. (JP)

( * ) Notice: Subject to any disclaimer, the term of this patent is extended or adjusted under 35 U.S.C. 154(b) by 314 days.

(21) Appl. No.: 11/282,146

(22) Filed: Nov. 18, 2005

(65) Prior Publication Data

US 2006/0133857 A1 Jun. 22, 2006

(30) Foreign Application Priority Data

Dec. 22, 2004 (JP) ..... 2004-370872

(51) Int. Cl.
*G03G 15/09* (2006.01)

(52) U.S. Cl. ..... 399/267

(58) Field of Classification Search ..... 399/107, 399/119, 252, 265, 266, 267
See application file for complete search history.

(56) References Cited

U.S. PATENT DOCUMENTS 5,571,987 A * 11/1996 Goto et al. ..... 399/276
5,812,909 A * 9/1998 Oguma et al. ..... 399/103
5,812,911 A * 9/1998 Asanae ..... 399/130
6,397,031 B1 * 5/2002 Itoh ..... 399/269

* cited by examiner

*Primary Examiner*—Hoan Tran
(74) *Attorney, Agent, or Firm*—Squire, Sanders & Dempsey L.L.P.

(57) ABSTRACT

There is described an image forming apparatus for forming a high-density image by using the reversal developing method and suppressing an occurrence of irregularities. The apparatus includes an image bearing member, a latent image forming device to form an electrostatic latent image, a magnetic field generating device to generate a magnetic field and a developing device to develop the electrostatic latent image so as to form a toner image on the image bearing member. At a developing region, the developer bearing member moves in a direction opposite to a moving direction of the image bearing member and the magnetic field generating device has a developing pole to form a magnetic brush for developing the electrostatic latent image. Further, an outer diameter R (mm) of the developer bearing member and a magnetic flux density Br1 (mT) of the developing pole fulfill the relationship of Br1≧R×4.5.

7 Claims, 2 Drawing Sheets

IMAGE FORMING APPARATUS

This application is based on Japanese Patent Application NO. 2004-370872 filed on Dec. 22, 2004 in Japanese Patent Office, the entire content of which is hereby incorporated by reference.

BACKGROUND OF THE INVENTION

The present invention relates to an image forming apparatus of an electrophotographic method and more particularly to improvement of a developing art.

In recent years, there is an increasing need for high-speed performance and high-quality performance of an image forming apparatus of an electrophotographic method.

As an art for responding to such a need, a developing art using toner with a small particle diameter has been developed. Further, the particle diameter of a carrier is apt to become smaller in correspondence with use of toner with a small particle diameter.

The small particle diameter of the carrier not only corresponds to realization of the small particle diameter of toner but also suppresses irregularities of a half-tone image due to the small particle diameter of the carrier and can form an image with a smooth outline.

As mentioned above, the small particle diameter of the carrier is an advantageous means for forming a high-quality image, though in correspondence with realization of the small particle diameter, the magnetization of each particle of the carrier is reduced, thus a problem arises that the carrier is easily adhered. As a measure for this problem, that is, to prevent carrier adhesion, it is necessary to make the magnetization of the carrier larger. However, when the magnetization of the carrier is made larger, the bristles of the magnetic brush for executing development are raised, and the bulk density of the bristles is lowered, and as a result, a problem arises that a half-tone image is made uneven.

In Patent Document 1, to prevent an occurrence of irregularities, it is proposed to reduce the product of the particle diameter of the carrier and the magnetization to a fixed value or smaller and increase the magnetic flux density peak to a fixed value or larger.

[Patent Document 1]

Japanese Patent No. 3308681

In the developing method of Patent Document 1, in the developing area, the image bearing member and developer bearing member are moved in the same direction, thus the development is executed. However, in the developing method for moving the image bearing member and developer bearing member in the same direction like this and executing the development, a problem that high density is hardly obtained and a problem that the carrier is easily adhered arise.

By a reversal developing method for moving the image bearing member and developer bearing member in opposite directions in the developing area and executing the development, such problems can be solved.

However, in the reversal developing method, it is found that irregularities are easily caused.

SUMMARY OF THE INVENTION

To overcome the abovementioned drawbacks in conventional image forming apparatus, it is an object of the present invention to provide an image forming apparatus for forming a high-density image by using the reversal developing method and suppressing an occurrence of irregularities, thereby forming a high-quality image.

Accordingly, to overcome the cited shortcomings, the abovementioned object of the present invention can be attained by image forming apparatus described as follow.

(1) An image forming apparatus, comprising: an image bearing member; a latent image forming device to form an electrostatic latent image on the image bearing member; a magnetic field generating device to generate a magnetic field to be applied onto both a developer bearing member and the image bearing member; and a developing device to develop the electrostatic latent image so as to form a toner image on the image bearing member; wherein, at a developing region, the developer bearing member moves in a direction opposite to a moving direction of the image bearing member and the magnetic field generating device has a developing pole to form a magnetic brush for developing the electrostatic latent image; and wherein an outer diameter of the developer bearing member and a magnetic flux density of the developing pole fulfill the relationship indicated as follow:

$$Br1 \geqq R \times 4.5$$

where Br1 (mT): magnetic flux density of the developing pole,

R (mm): outer diameter of the developer bearing member.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

<Image Forming Apparatus>

Figure 1:
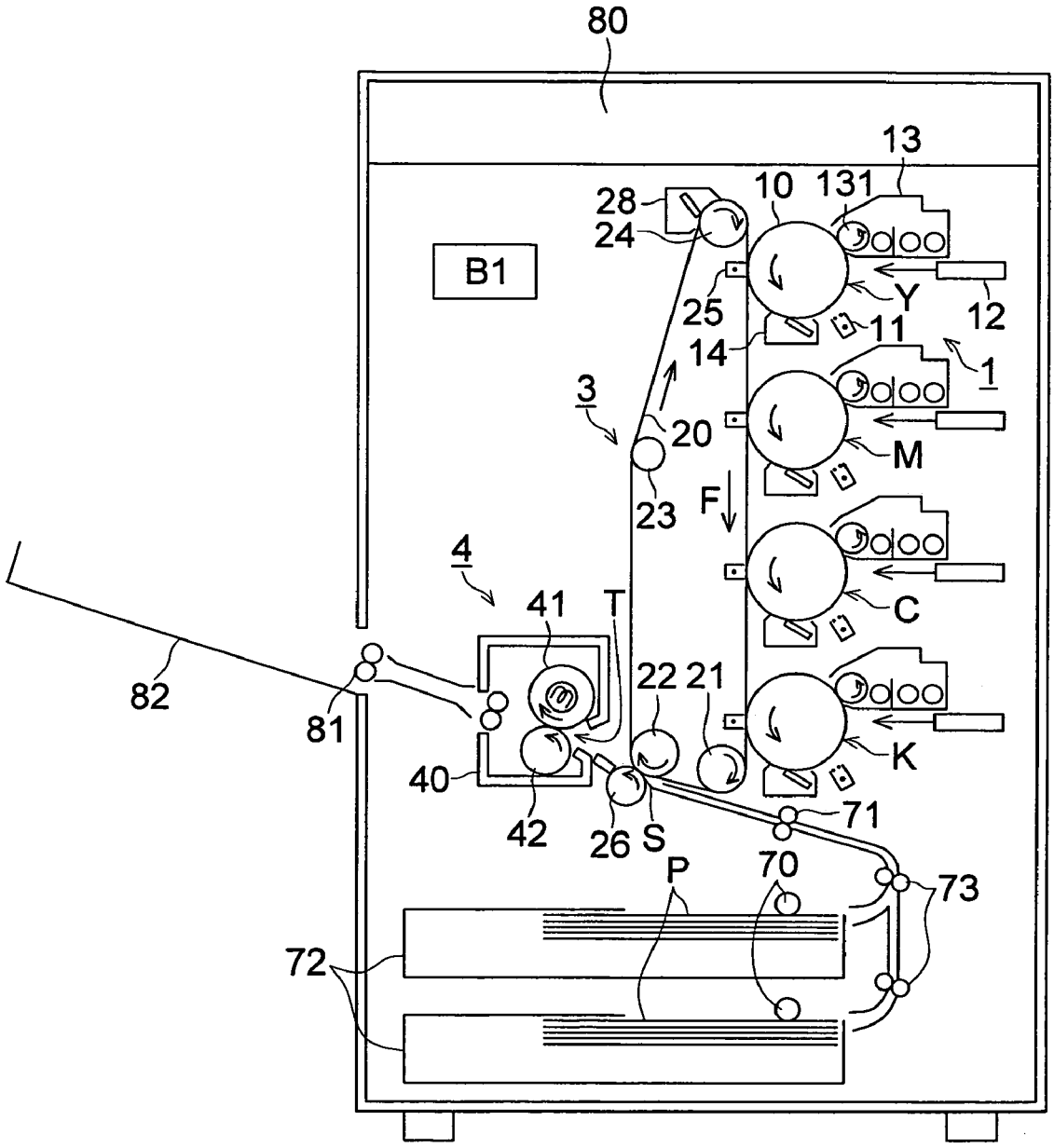
FIG. 1 is a schematic view showing an example of the whole constitution of the image forming apparatus relating to the embodiment of the present invention.

FIG. 1 is a schematic view showing an example of the whole constitution of the image forming apparatus relating to the embodiment of the present invention.

In FIG. 1, numeral 10 indicates a photosensitive drum as a latent image bearing member, 11 a charger, 12 an exposure, 13 a developing device, 14 a cleaner for cleaning the surface of the photosensitive drum 10, 131 a developing sleeve as a developer bearing member composing the developing device 13, and 20 an intermediate transfer belt. An image forming unit 1 is composed of the photosensitive drum 10, charger 11, developing device 13, and cleaner 14 and the mechanical constitution of the image forming unit 1 for each color is the same, so that in FIG. 1, the reference numerals are assigned to the components of only the Y (yellow) series and for the components of M (magenta), C (cyan), and K (black), the reference numerals are omitted. The charger 11 and exposure 12 compose a latent image forming means for forming an electrostatic latent image on the latent image bearing member.

The image forming unit 1 for each color, in the traveling direction of the intermediate transfer 20, is arranged in the order of Y, M, C, and K and each photosensitive drum 10 is in contact with the stretched surface of the intermediate transfer belt 20 and rotates at the contact in the same direction as the traveling direction of the intermediate transfer belt 20 and at the same linear speed.

The intermediate transfer belt 20 is stretched and suspended by a drive roller 21, an grounded roller 22, a tension roller 23, and a driven roller 24 and these rollers and the intermediate transfer belt 20, transfer device 25, and cleaner 28 compose a belt unit 3.

The intermediate transfer belt 20 moves by the rotation of the drive roller 21 by a drive motor (not shown in the drawings).

The photosensitive drum 10 is, for example, composed of a photosensitive layer such as a conductive layer, an a-Si layer, or an organic photoconductor (OPC) which is formed on the outer periphery of a cylindrical metallic base made of an aluminum material and rotates in the counterclockwise direction indicated by the arrow in FIG. 1 in the state that the conductive layer is grounded.

An electric signal corresponding to image data from a reader 80 or an external device is converted to an optical signal by an image forming laser and an image is exposed on the photosensitive drum 10 by the exposure 12.

A developing device 13 has a developing sleeve 131 as a developer bearing member formed from a cylindrical non-magnetic stainless steel or aluminum material and the developing sleeve 131 moves in the opposite direction to a photosensitive drum 10 in the developing area opposite to the photosensitive drum 10.

The intermediate transfer belt 20 is an endless belt with a volume resistivity of $10^6$ to $10^{12}$ Ω cm and it is a semiconductive seamless belt with a thickness of 0.015 to 0.05 mm in which a conductive material is dispersed in engineering plastics such as modified polyimide, thermosetting polyimide, ethylene tetrafluoroethylene copolymer, polyvinylidene fluoride, or nylon alloy.

Numeral 25 indicates a transfer device, which has a function for transferring a toner image, which is applied with a direct current of the reverse polarity to the toner and is formed on the photosensitive drum 10, onto the intermediate transfer belt 20. For the transfer device 25, in addition to a corona discharger, a transfer roller can be used.

Numeral 26 indicates a transfer device composed of a transfer roller, which can make contact with and separate from the grounded roller 22 and retransfers a toner image formed on the intermediate transfer belt 20 to a recording material P.

Numeral 28 indicates a cleaner having a cleaning blade 29 and is installed opposite to the driven roller 24 across the intermediate transfer belt 20. After transferring the toner image to the recording material P, the intermediate transfer belt 20 passes the cleaner 28 and is cleaned toner remaining on the peripheral surface thereof by the cleaning blade 29.

Numeral 70 indicates a paper feed roller, 71 a timing roller, 72 paper cassettes, and 73 conveying rollers.

Numeral 4 indicates a fixing device, which heats, pressurizes, and fixes the toner image on the recording material P, which is transferred from the intermediate transfer belt 20, in a nipping section T formed by a heat roller 41 and a press roller 42. Numeral 81 indicates paper discharge rollers, which discharge the fixed recording material to a paper discharge tray 82.

<Developing Device>

Next, the developing device 13 will be explained.

As developing device 13, a developing device using a two-component developer composed of main components of a carrier and toner is used, though a two-component developing device using toner with a small particle diameter is preferable. Further, the developing device can use both regular development and reverse development, though the reverse development of applying the developing bias of the same polarity as that of the charge of the photosensitive drum 10 to the developing sleeve 131 and using toner charged at the same polarity as that of the charge of the photosensitive drum for development is preferable. In this embodiment, the reverse development using negatively charged toner is used for development.

Toner with a small particle diameter such as a mean volume particle diameter of 4.5 μm to 6 μm is preferable.

The mean volume particle diameter is measured by the method indicated below.

The mean volume particle diameter is measured and calculated using a device composed of a Coulter Multisizer II (manufactured by Beckman Coulter, Inc.) connected to a data processing computer system (manufactured by Beckman Coulter, Inc.).

The measuring procedure is that toner of 0.02 g is allowed to become accustomed to a surface-active agent of 20 ml (for the purpose of dispersion of toner, for example, a surface-active agent solution in which a neutral detergent including a surface-active agent component is diluted to 10 times in pure water) and then is subject to ultrasonic dispersion for one minute, thus a toner dispersed liquid is prepared. The toner dispersed liquid is injected into a beaker containing ISOTON II (manufactured by Beckman Coulter, Inc.) in the sample stand up to measurement density of 5% to 10% by a pipette and the particle diameter is measured by setting the count of a measuring instrument to 30000. Further, the aperture diameter of the Coulter Multisizer is 100 μm.

By such toner with a small particle diameter, a high-quality image of high resolution can be formed. In toner with a mean volume particle diameter larger than 6 μm, the characteristic of high image quality is reduced.

When toner with a mean volume particle diameter smaller than 4.5 μm is used, the image quality is easily lowered due to fog, etc.

For toner with a small particle diameter as mentioned above, it is desirable to use polymerized toner.

The polymerized toner means toner obtained by generating toner binder resin and forming the toner shape by polymerization of the raw monomer of the binder resin or prepolymer and the subsequent chemical treatment. More concretely, it means toner obtained via the polymerization reaction such as suspension polymerization or emulsion polymerization and the fusing step of particles executed thereafter as required. The polymerized toner is manufactured by uniformly dispersing the raw monomer or prepolymer in a water series medium and then polymerizing it, so that toner in a uniform particle size distribution and shape can be obtained.

Concretely, the polymerized toner can be manufactured by the suspension polymerization method or by a method of emulsion-polymerizing a monomer in a water series medium solution added with an emulsifier, manufacturing polymerized fine particles, and thereafter adding and associating an organic solvent medium and a flocculent. In addition, a method, at time of association, of mixing and associating a dispersion liquid such as a release agent and a coloring agent necessary for the toner constitution and a method of dispersing the toner constituent components such as the release agent and coloring agent in the monomer and then emulsion-polymerizing them may be cited. Here, the association is referred to as fusion of a plurality of resin particles and coloring agent particles The carrier composing a two-component developer is a magnetic carrier and a carrier with a small particle diameter having a mean volume particle diameter of 25 μm to 45 μm and magnetization of $6.3\times10^5$ wb·m/kg to $7.5\times10^6$ wb·m/kg is preferable.

The mean volume particle diameter of the carrier is a mean particle diameter based on the volume measured by the laser diffraction method and the D50 value measured by the HELOS System (manufactured by Sympatec GmbH) under the following condition is assumed as a mean volume particle diameter.

Measuring method: Suspension cell

Focal distance: 100 mm

Solution: Water+surface-active agent

Ultrasound impression time: 20 seconds

Rest rime: 10 seconds

Measuring time: 15 seconds

By such a carrier with a small particle diameter, a half-tone image free of irregularities and with a smooth outline can be formed and a developer of toner density necessary for use of toner with a small particle diameter can be adjusted. When the mean volume particle diameter is larger than 45 μm, the image quality is lowered and it is difficult to obtain the toner density necessary for use of toner with a small particle diameter.

Further, when a carrier with magnetization of $6.3\times10^5$ wb·m/kg to $7.5\times10^6$ wb·m/kg is used, a high-quality image of little carrier adhesion can be formed. When the magnetization is lower than $6.3\times10^5$ wb·m/kg, the carrier is easily adhered and when the magnetization is higher than $7.5\times10^6$ wb·m/kg, the bristles of the magnetic brush are raised excessively and irregularities are easily generated on a half-tone image.

For magnetic particles of the magnetic carrier, a conventional well-known material such as a metal of iron, ferrite, or magnesite, or an alloy of any of those metals and a metal of aluminum or lead is used. Particularly, ferrite particles are preferable.

For the carrier, magnetic particles, magnetic particles additionally covered with resin, or the so-called resin dispersed carrier composed of magnetic particles dispersed in resin is preferable. The coating resin composition is not restricted particularly and for example, olefin resin, styrene resin, styrene-acrylic resin, silicone resin, ester resin, or fluorine containing polymer resin is used. Further, the resin for composing a resin dispersed carrier is not restricted particularly, and a well-known resin can be used, and for example, styrene-acrylic resin, polyester resin, fluorine resin, or phenolic resin can be used. Incidentally, although descriptions with respect to the diameter of a carrier particle, etc. will be provided later on, the diameter of a carrier particle is measured in the same method as that for the diameter of a toner particle.

Figure 2:
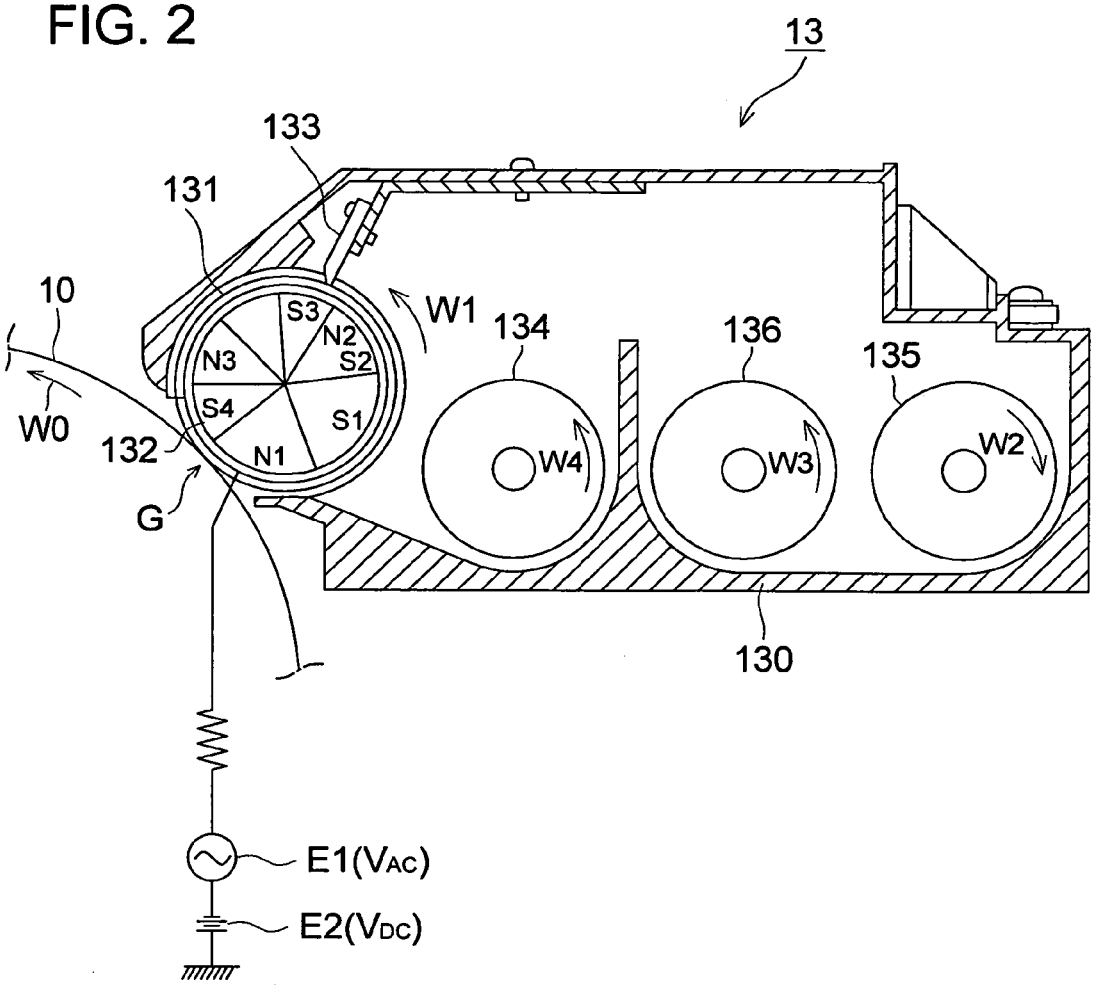
FIG. 2 shows an enlarged cross sectional view of a developing device.

FIG. 2 shows an enlarged cross sectional view of the developing device 13 shown in FIG. 1.

In FIG. 2, numeral 130 indicates a casing for storing a two-component developer composed of toner and a carrier and inside the developing sleeve 131, formed in a cylindrical shape, as a developer bearing member, a fixed magnet roller 132 as a magnetic field generating means is installed. The magnet roll 132 has three north poles indicated by N1 to N3 and four south poles indicated by S1 to S4. Incidentally, an arrangement and a number of magnetic poles of the fixed magnet roller 132 are not limited to the example shown in the drawing. It is possible to modify it into wide variety of modified examples.

The pole N1 is a developing pole for forming a magnetic brush of the developer for conducting the developing operation in the developing area G where the developing sleeve 131 is opposite to the photosensitive drum 10, and the poles S1 and S2 are magnetic poles for forming a repulsion magnetic field, and by the repulsion magnetic field, the developer on the developing sleeve 131 is separated.

The pole S1 is a downstream side magnetic pole located downstream in the vicinity of the pole N1, serving as a developing pole.

The pole S2 is a catching pole for adhering the developer to the developing sleeve 131.

A pole S4 is an upstream pole neighboring on the upstream side with a pole N1 which is a developing pole.

Further, with respect to the arrangement of the magnetic poles, "upstream" and "downstream" are used on the basis of the rotational direction of the developing sleeve 131 and mean "upstream" and "downstream" of the flow of the developer.

The developing sleeve 131 rotates as shown by an arrow W1 and conveys the developer. S2, N2, S3, N3, S4, and N1 sequentially formed in the conveying direction form a conveying magnetic pole row in which different poles are arranged alternately and the developer is conveyed by the conveying magnetic pole row and is supplied to the developing area G. In the position opposite to the pole N2, a control member 133 is arranged in the neighborhood of the developing sleeve 131, and the amount of the developer to be conveyed is controlled by the developing sleeve 131, and a uniform layer of the developer is formed on the developing sleeve 131.

As shown in the drawing, the developing sleeve 131, in the developing area G opposite to the photosensitive drum 10, moves in the opposite direction to the photosensitive drum 10, supplies the developer to the developing area G, and executes development. By such reversal development, a toner image of high density is formed and an occurrence of carrier adhesion, that is, the carrier is adhered to the photosensitive drum 10, is suppressed.

Numeral 135 indicates a first screw for stirring and conveying the developer. The first screw 135 rotates as shown by an arrow W2 in FIG. 2 and conveys the developer in the rotational direction thereof by stirring it. A second screw 136 rotates as shown by an arrow W3 and conveys the developer in the rotational direction thereof by stirring it. Further, the developer conveying directions of the first screw 135 and the second screw 136 are opposite to each other.

Toner is supplied to the developer stirring chamber wherein the first screw 135 is arranged.

To the developing sleeve 131, a developing bias voltage in which a DC voltage is superimposed to an AC voltage by power sources E1 and E2 is applied.

The developer contains toner charged at the same polarity as that of the photosensitive drum and the developing bias voltage having the DC component at the same polarity as the charging polarity of the photosensitive drum 10 is applied.

The developing bias voltage is applied to the developing sleeve 131 by the power sources E1 and E2, and the photosensitive drum is rotated counterclockwise as shown by W0, and the developing sleeve 131 is rotated counterclockwise as shown by the arrow W1, and an electrostatic latent image on the photosensitive drum 10 is developed.

In the developing device 13 explained above, by the developing pole N1 meeting the following condition, irregularities of the intermediate density part are suppressed satisfactorily. Further, the value of magnetic flux density used in this specification is a value in a unit of mT measured in the position at a distance of 0.1 mm from the surface of the developer bearing member (the developing sleeve 131).

Condition of the present invention—The magnetic flux density Br1 (mT) of the developing pole (pole N1) meets Br1 ≧R×4.5, where R (mm) indicates a diameter of the outer periphery of the developing sleeve 131.

When the magnetic flux density Br1 is smaller than R×4.5, irregularities are easily generated.

Further, when the following condition is satisfied, the image quality can be improved more.

Preferable Condition 1—The upstream pole (pole S4) neighboring on the upstream side with the developing pole (pole N1) is arranged at a distance of less than 8 mm on the upstream side from the developing pole (pole N1). When the condition is satisfied, irregularities can be suppressed more.

When the upstream pole (pole S4) is formed at a distance of more than 8 mm from the developing pole (pole N1), irregularities are easily generated.

Preferable Condition 2—The magnetic flux density Br2 of the upstream pole (pole S4) meets Br1 ≧Br2 ≧80 mT. Under this condition, carrier adhesion can be suppressed.

When the magnetic flux density of the upstream pole (pole S4) is lower than 80 mT, carrier adhesion is easily generated.

Preferable Condition 3—downstream pole (pole S1) neighboring on the downstream side with the developing pole (pole N1) is arranged at a distance of less than 12 mm on the downstream side from the developing pole (pole N1). Under this condition, the bristles of the magnetic brush at the developing nip can be prevented from clogging.

Even when the downstream pole (pole S1) is formed at a distance of more than 12 mm from the developing pole (pole N1), the bristles at the developing nip becomes clogged easily.

Preferable Condition 4—The magnetic flux density Br3 of the downstream pole (pole S1) meets Br1 ≧Br3≧80 mT. Under this condition, the bristles of the magnetic brush at the developing nip can be prevented from clogging.

When the magnetic flux density of the downstream pole (pole S1) is lower than 80 mT, in the developing area G, bristle clogging, that is, the developer becomes clogged at the developing nip formed by the photosensitive drum 10 and the developing sleeve 131, is easily generated. Further, it is desirable that the magnetic flux densities Br1, Br2, and Br3, from the viewpoint of possibility of manufacture of a magnet, are 200 mT or lower.

Various problems imposed in the development explained above are easily caused in the high-speed development for moving the photosensitive drum 10 at a linear speed of 220 mm/s or higher and under the aforementioned conditions of the present invention, those problems in the high-speed development are solved. And, under the preferable Conditions 1 to 4, in the high-speed development, images of higher quality can be formed.

And, when the development is executed by combining more than one among the preferable Conditions 1 to 4 with the conditions of the present invention, images of higher quality can be formed.

Embodiment

Images are formed under the following condition and the formed images are evaluated.

Photosensitive drum: An OPC photosensitive drum composed of an aluminum base drum on which a negatively charged organic photosensitive layer is coated Potential of unexposed part of photosensitive drum: −650 V Toner: Negatively charged Mean volume particle diameter: 6 μm Carrier: Mean volume particle diameter: 40 μm Magnetization: $6.9\times10^5$ wb·m/kg Developing bias voltage: DC component: −500 V AC component (square wave): Voltage 10 kvp-p, frequency: 5 kHz Developer conveying amount on developing sleeve: 250 $g/m^2$ Developing gap (shortest distance between photosensitive drum and developing sleeve) Ds: 0.3 mm Outside diameter of developing sleeve (diameter): A: 30 mm, B: 25 mm, C: 20 mm The image forming conditions and evaluation results are shown in Tables 1 to 3.

Table 1 shows a case that the developing sleeve A (outside diameter 30 mm) is used, and Table 2 shows a case that the developing sleeve B (outside diameter 25 mm) is used, and Table 3 shows a case that the developing sleeve C (outside diameter 20 mm) is used.

In Table 1, the "bite amount of developing bristles" is a value obtained when the photosensitive drum 10 and the developing sleeve 131 are kept at a distance, and the developing sleeve 131 is rotated, and the bristles of the magnetic brush are formed on the developing sleeve 131, and the height H of the bristles is measured by microscopic observation and the bite amount of the bristles of the magnetic brush is H−Ds.

Further, the "contact width" is a value measured by the following method.

Figure 3:
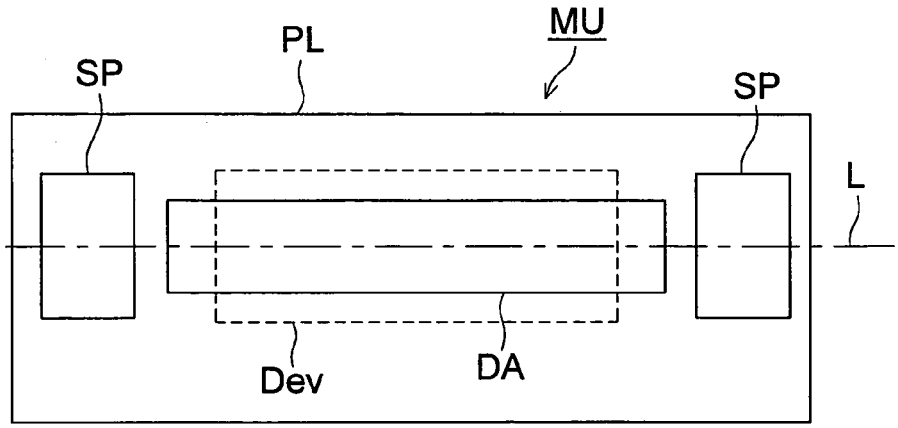
FIG. 3 shows a schematic diagram of a measuring unit for measuring a contacting width of a developer.

A measuring unit MU is shown in FIG. 3. The measuring unit MU prepared by fixing spacers SP with a thickness of "developing gap Ds+Dd" on plastics PL at both ends thereof and sticking a pressure sensitive adhesive double coated tape DA with a thickness of Dd between the spacers SP is provided beforehand. As shown in the drawing, the spacers SP and the pressure sensitive adhesive double coated tape DA are arranged side by side centering on the straight line L.

Next, the photosensitive drum 10 and the developing sleeve 131 are kept at a distance, and the developing sleeve 131 is rotated, and the bristles of the magnetic brush are formed on the developing sleeve 131, and then the part corresponding to the developing pole N1, that is, the part with a width of 50 mm including the developing area G is left, and the developer is removed from the developing sleeve 131.

Next, the spacers SP of the measuring unit MU, as shown by a dotted line, after positioning so that the center of the developer layer Dev in the width direction can almost coincide with the straight line L, make contact with the developing sleeve 131.

Next, the measuring unit MU is removed, and the width of the developer adhered to the pressure sensitive adhesive double coated tape DA is measured, and the measured value is assumed as a contact width.

Further, each mark "#" in the table indicates outside the range of the conditions of the present invention or preferable conditions.

The meanings of the symbols in the evaluation result item in Tables 1 to 3 are as indicated below.

Irregularities: Experimental examples showing irregularities in a half-tone image are indicated by C and experimental examples free of irregularities are indicated by C. BC indicates experimental examples showing a few irregularities.

Carrier adhesion: Experimental examples showing white defects in a solid image are indicated by D, and experimental examples, although free of white defects, showing scratches on the photosensitive drum when 500000 images are formed are indicated by C, and experimental examples free of white detects and scratches of the photosensitive drum are indicated by B. Further, "-" shown in the tables indicates experimental examples in which no images are formed due to clogging of the bristles of the magnetic brush, thus carrier adhesion cannot be evaluated.

Excessive density at rear end: In a tetragon solid image, experimental examples of an image of remarkably uneven density in which a high-density part is formed at the rear end of the photosensitive drum in the movement direction are indicated by D, and experimental examples of slightly uneven density are indicated by C, and experimental examples free of uneven density are indicated by B.

Clogging of bristles at developing nip: Experimental examples showing fog due to an occurrence of clogging of the bristles in the developing gap are indicated by C, and experimental examples in which the developer is adhered onto the photosensitive drum due to clogging of the bristles are indicated by D, and experimental examples free of fog and developer adhesion are indicated by B.

TABLE 1

| | | | | | | |
|---|---|---|---|---|---|---|
| Magnetic flux density of developing pole Br1 (mT) | >30 | 145 | 145 | 145 | 145 | 145 |
| Br1/R | 4.3 | 4.8 | 4.8 | 4.8 | 4.8 | 4.8 |
| Distance of upstream pole (mm) | 4 | 4 | #10 | 7 | 7 | 7 |
| Magnetic flux density of upstream pole Br2 (mT) | 85 | 85 | 85 | #75 | 85 | 85 |
| Distance of downstream pole (mm) | 10 | 10 | 10 | 10 | #13 | 10 |
| Magnetic flux density of downstream pole Br3 (mT) | 85 | 85 | 85 | 85 | 85 | #75 |
| Bite amount of developing bristles | 0.4 | 0.15 | 0.3 | 0.15 | 0.2 | 0.2 |
| Contact width (mm) | 4 | 2 | 3.5 | 2 | 3 | 3 |
| Carrier adhesion | B | B | B | C | B | — |
| Excessive density of rear end | C | B | BC | B | B | B |
| Excessive density of rear end | D | B | C | B | B | B |
| Bristle clogging at developing nip | B | B | B | B | C | D |

Outside diameter of developing sleeve R = 30 mm

TABLE 2

| | | | | | | |
|---|---|---|---|---|---|---|
| Magnetic flux density of developing pole Br1 (mT) | #110 | 120 | 120 | 120 | 120 | 120 |
| Br1/R | 4.4 | 4.8 | 4.8 | 4.8 | 4.8 | 4.8 |
| Distance of upstream pole (mm) | 7 | 7 | #10 | 7 | 7 | 7 |
| Magnetic flux density of upstream pole Br2 (mT) | 85 | 85 | 85 | #75 | 85 | 85 |
| Distance of downstream pole (mm) | 10 | 10 | 10 | 10 | #13 | 10 |
| Magnetic flux density of downstream pole Br3 (mT) | 85 | 85 | 85 | 85 | 85 | #75 |
| Carrier adhesion | B | B | B | C | B | — |
| Excessive density of rear end | C | B | BC | B | B | B |
| Excessive density of rear end | D | B | C | B | B | B |
| Bristle clogging at developing nip | B | B | B | B | C | D |

Outside diameter of developing sleeve R = 25 mm

TABLE 3

| | | | | | | |
|---|---|---|---|---|---|---|
| Magnetic flux density of developing pole Br1 (mT) | #85 | 90 | 90 | 90 | 90 | 90 |
| Br1/R | 4.25 | 4.5 | 4.5 | 4.5 | 4.5 | 4.5 |
| Distance of upstream pole (mm) | 7 | 7 | #10 | 7 | 7 | 7 |
| Magnetic flux density of upstream pole Br2 (mT) | 85 | 85 | 85 | #75 | 85 | 85 |
| Distance of downstream pole (mm) | 10 | 10 | 10 | 10 | #13 | 10 |
| Magnetic flux density of downstream pole Br3 (mT) | 85 | 85 | 85 | 85 | 85 | #75 |
| Carrier adhesion | B | B | B | C | B | — |
| Excessive density of rear end | C | B | BC | B | B | B |
| Excessive density of rear end | D | B | C | B | B | B |
| Bristle clogging at developing nip | B | B | B | B | C | D |

Outside diameter of developing sleeve R = 20 mm

From the results of Tables 1 to 3, it is found that in the experimental examples, when the condition of Br1 ≧R×4.5 (Br1/R Irregularities: Experimental examples showing 4.5) is satisfied in combination of various roll diameters and the magnetic flux density Br1, the problem of irregularities is improved. Further, it is also found that when the condition is satisfied, the density at the rear end of each image is improved.

Furthermore, when the position of the upstream pole to the magnetic pole of Br1 is 8 mm or less, the aforementioned problem of irregularities is improved more. Further, when the magnetic flux density Br2 of the upstream pole is smaller than 80 mT, carrier adhesion reoccurs, so that it is preferable to set Br2 to 80 mT or larger.

When the position of the downstream pole to the magnetic pole of Br1 is more than 12 mm and when the magnetic flux density Br3 of the downstream pole is smaller than 80 mT, the bristles become clogged at the developing nip. Particularly when Br3 is smaller than 80 mT, the carrier is adhered. On the other hand, when the position of the downstream pole is 12 mm or less and Br3 is 80 mT or larger, neither clogging of the bristles at the developing nip nor carrier adhesion occur.

According to the embodiments of the present invention, it becomes possible not only to form a high-density image, but also to provide a developing device that forms an image in which irregularities are sufficiently suppressed. Further, the excessive density at rear end, in which the excessive density part is generated at a trailing edge portion of one page, is also sufficiently suppressed.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

an image bearing member;

a latent image forming device to form an electrostatic latent image on said image bearing member;

a magnetic field generating device to generate a magnetic field to be applied onto both a developer bearing member and said image bearing member; and a developing device to develop said electrostatic latent image so as to form a toner image on said image bearing member;

wherein, at a developing region, said developer bearing member moves in a direction opposite to a moving direction of said image bearing member and said magnetic field generating device has a developing pole to form a magnetic brush for developing said electrostatic latent image; and wherein an outer diameter of said developer bearing member and a magnetic flux density of said developing pole fulfill the relationship indicated as follow:

$$Br1 \geqq R \times 4.5$$

where Br1 (mT): magnetic flux density of said developing pole,

R (mm): outer diameter of said developer bearing member.

2. The image forming apparatus of claim 1, wherein said magnetic field generating device has a upstream pole located at such a position that is adjacent to and upstream from said developing pole, and a distance between said upstream pole and said developing pole is equal to or smaller than 8 mm.

3. The image forming apparatus of claim 1, wherein said magnetic field generating device has an upstream pole located at such a position that is adjacent to and upstream from said developing pole, and a magnetic flux density of said upstream pole fulfills the relationship indicated as follow:

$$Br1 \geqq Br2 \geqq 80\ mT$$

where Br2 (mT): magnetic flux density of said upstream pole.

4. The image forming apparatus of claim 1, wherein said magnetic field generating device has a downstream pole located at such a position that is adjacent to and downstream from said developing pole, and a distance between said downstream pole and said developing pole is equal to or smaller than 12 mm.

5. The image forming apparatus of claim 1, wherein said magnetic field generating device has an downstream pole located at such a position that is adjacent to and downstream from said developing pole, and a magnetic flux density of said downstream pole fulfills the relationship indicated as follow:

$$Br1 \geqq Br3 \geqq 80\ mT$$

where Br3 (mT): magnetic flux density of said downstream pole.

6. The image forming apparatus of claim 1, wherein a developer, which contains toner and carrier as main ingredients, is employed for developing said electrostatic latent image; and wherein, with respect to said carrier, a mean volume particle diameter is in a range of 25-45 μm and a strength of magnetization is in a range of $6.3\times10^{5}$–$7.5\times10^{6}$ wb·m/kg.

7. The image forming apparatus of claim 1, wherein a toner, a mean volume particle diameter of which is in a range of 4.5-6.5 μm, is employed for developing said electrostatic latent image.

* * * * *